United States Patent [19]

Campbell et al.

[11] 4,040,479

[45] Aug. 9, 1977

[54] FINNED TUBING HAVING ENHANCED NUCLEATE BOILING SURFACE

[75] Inventors: Bonnie J. Campbell, Decatur, Ala.; Klaus R. Rieger, West Orange, N.J.

[73] Assignee: UOP Inc., Des Plaines, Ill.

[21] Appl. No.: 610,039

[22] Filed: Sept. 3, 1975

[51] Int. Cl.[2] ..... F28F 13/18

[52] U.S. Cl. ..... 165/133

[58] Field of Search ..... 165/133

[56] References Cited

U.S. PATENT DOCUMENTS

| | | | |
|---|---|---|---|
| 3,326,283 | 6/1967 | Ware | 165/133 X |
| 3,454,081 | 7/1969 | Kun et al. | 165/133 |
| 3,566,514 | 3/1971 | Szumigala | 165/133 X |
| 3,789,915 | 2/1974 | Ford | 165/133 X |
| 3,893,322 | 7/1975 | Campbell et al. | 165/133 X |
| 3,906,604 | 9/1975 | Kakizaki et al. | 165/133 X |

*Primary Examiner*—Carroll B. Dority, Jr.

*Assistant Examiner*—Sheldon Richter

*Attorney, Agent, or Firm*—James R. Hoatson, Jr.; Barry L. Clark; William H. Page, II

[57] ABSTRACT

An improved nucleate boiling surface can be obtained on a finned metal heat transfer tube by providing very narrow transverse gaps in its fins. The narrow gaps can be attained by knurling or otherwise deforming a smooth surfaced tube member to notch and partially work harden its surface and then subjecting the knurled portion to a finning operation. The resulting tube has fissure like gaps having a tapered width in the range of 0-0.006 inches in the tip area of the fins which become nucleation sites for boiling enhancement. In a metal working apparatus, by mounting the knurling rolls on the same arbors as the finning disks, a tube can be progressively knurled and then finned in a single pass through the apparatus. If desired, the tube can also be internally ridged as it is being externally finned.

10 Claims, 6 Drawing Figures

Fig. 2
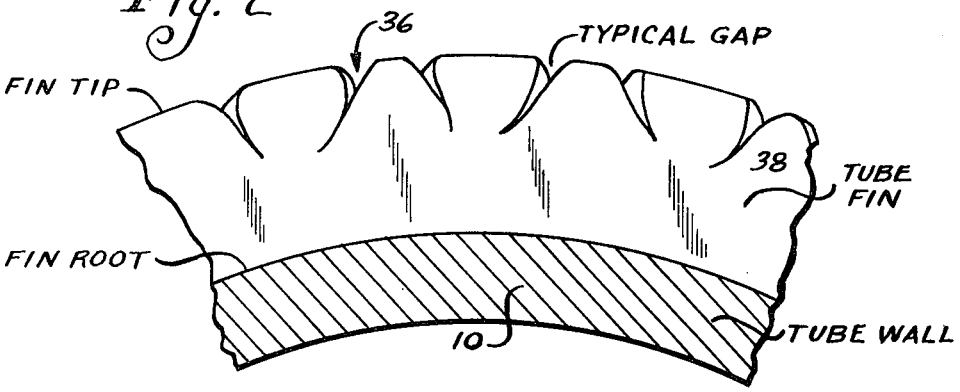
Fig. 3
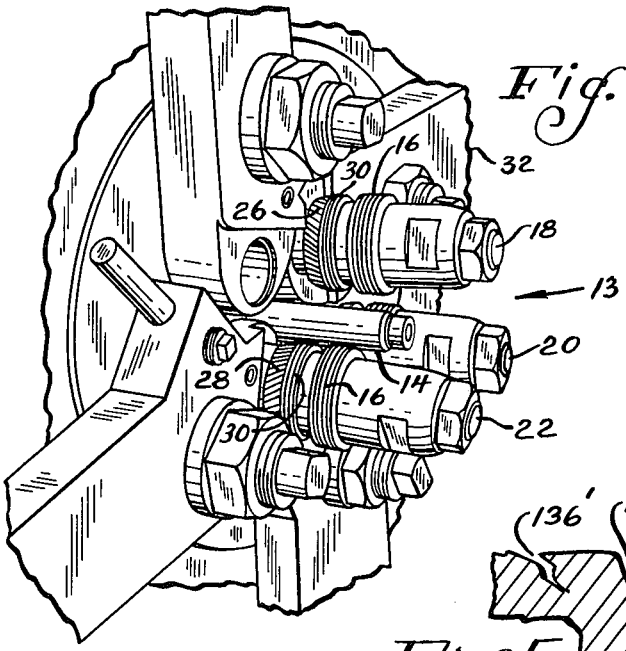
Fig. 1
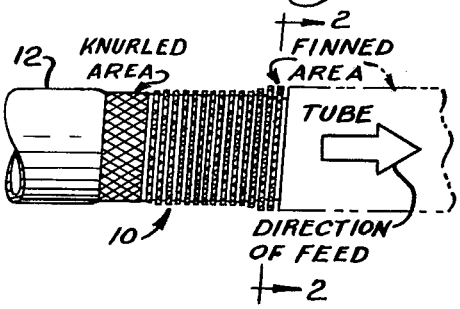
Fig. 5
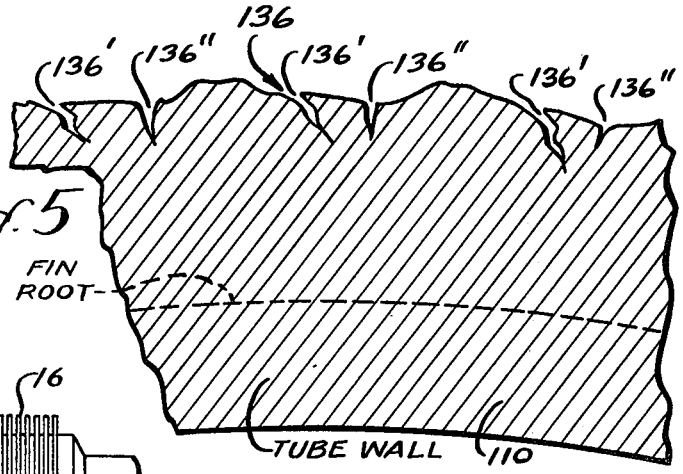
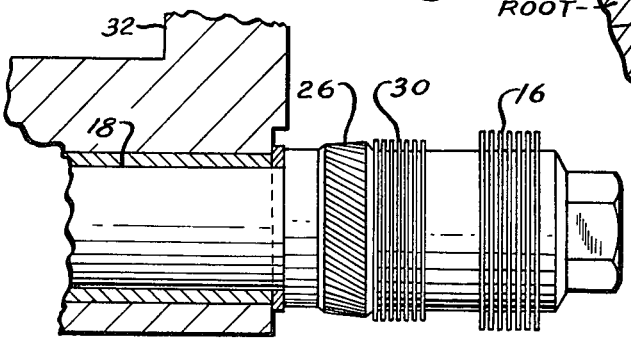
Fig. 4
Fig. 6
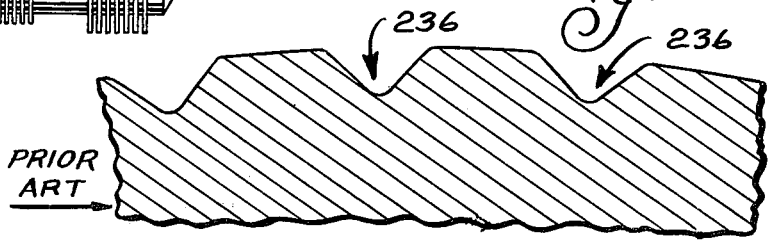

FINNED TUBING HAVING ENHANCED NUCLEATE BOILING SURFACE

CROSS-REFERENCE TO RELATED APPLICATION

U.S. Pat. No. 3,893,322 is directed to a method of making tubing of the type disclosed herein and is assigned to a common assignee.

BACKGROUND OF THE INVENTION

This invention relates to metal tubing which has the efficiency of heat transfer of its surface enhanced. It is known in the art that modifying the surface of a plain cylindrical tube such as by finning or corrugating it or by scoring, knurling, or roughening its surface will increase its heat transfer capability in boiling of liquids substantially as compared to a plain tube. Patent 3,454,081 teaches beneficiation of a planar heat transfer surface via a scoring and knurling technique in which the ridges formed by scoring are partly deformed, by a subsequent knurling operation, into the grooves separating them to obtain partially enclosed and connected subsurface cavities for vapor entrapment and the consequential promotion of nucleate boiling. U.S. Pat. Nos. 3,326,283 and 3,602,027 teach knurling after finning while U.S. Pat. Nos. 3,683,656 and 3,696,861 teach partially bending over the fins to form cavities. U.S. Pat. No. 3,789,915 teaches that a tube may be corrugated or knurled (but not both) to get a folded metal configuration having subsurface cavities. U.S. Pat. No. 3,355,788 relates to heat transfer of gas rather than boiling liquids and discloses the use of saws to slit finned tubing to increase turbulence. As a general rule, finning has always been done on plain smooth surfaces because it is known that surface imperfections can lead to fin splits of uncontrolled depth and orientation. This type of fin imperfection has been avoided in the past for fear that splits penetrating into the tube wall might cause undue degradation of mechanical properties. Splits are now identified non-destructively by eddy current test methods, which are applied at the tube manufacturing stage. Generally, splits are not permitted to penetrate deeper than 10% of the tube wall thickness — a tube having excessively deep splits is scrapped. However, splits in the fin tips and those not penetrating deeper than 10% of the tube wall thickness are acceptable.

Since heat transfer tubing is generally made of expensive materials such as copper and is used in large quantities, it is obvious that improvements in heat transfer efficiency and/or in manufacturing costs can be quite significant in reducing the overall cost of a given heat exchange installation.

It is an object of this invention to provide finned tubing which has increased heat transfer capability compared to conventional finned tubing in nucleate boiling applications.

SUMMARY OF THE INVENTION

Our improved tubing can be produced by starting with a plain surface tube, knurling the tube at an angle to its axis so that its surface is lightly impressed or embossed with a diamond pattern of grooves having rounded bottoms and then subjecting it to a finning operation. The knurling operation tends to work harden the tube in the region of the knurling impression and the additional metalworking inherent in the finning operation then causes the impressions to split or rupture, thereby forming a great number of very small gaps or cavities in the outer radial portions of the fins which are nucleation sites for boiling enhancement. The diamond knurling pattern is preferably obtained by using a pair of knurling tools having their ridges arranged at an angle to each other and at about a 30° angle to the tube axis. The resultant diagonally oriented splits which are promulgated in the fin tips average less than about 0.003 inch in width but are tapered over their depth of up to about 0.025 inch so as to vary in width from about 0–0.006 inch. The splits are much narrower than could be produced by a slotting operation and are sufficiently narrow as to be capable of initiating and sustaining nucleate boiling. Since the splits are tapered, they accommodate improved boiling in fluids having different physical properties, such as surface tension and latent heat of vaporization. Furthermore, since the splits are confined to the fin tips, they do not weaken the mechanical strength of the tube wall. Although a pair of knurling tools are preferable for use in deforming a tube surface, other types of tools could also be used which would provide a local workhardened condition. Furthermore, a knurling tool producing grooves aligned with the tube axis could be used but would form shorter splits than an angled groove.

Use of our improved method in the manufacture of finned tubing has been shown in tests to provide an improvement in heat transfer efficiency on the outside surface of a finned tube whereby the outside film coefficient of heat transfer, at a given value of wall superheat, was increased approximately 80% as compared with the unimproved reference finned tube. Alternatively, the improved surface showed 28% improvement in single tube boiling coefficient at a given heat flux. In a practical system one would expect to increase the heat flux and the degree to which this is possible depends on the other thermal resistances in the system; that is, the lower the film resistance of the heating side fluid the more overall benefit to be derived via the boiling side improvement.

BRIEF DESCRIPTION OF THE DRAWINGS

FIG. 1 is a side view of a portion of an improved heat transfer tube made in accordance with the invention;

FIG. 2 is a fragmentary sectional view of a portion of the tube shown in FIG. 1 taken on line 2—2 of FIG. 1;

FIG. 3 is a perspective view of a suitable work station (with one arbor removed for clarity) for producing the tube of FIG. 1;

FIG. 4 is a side view of one of the knurling and finning tools shown in FIG. 3;

FIG. 5 is a view similar to FIG. 1 but shows cross-sections of the narrow transverse gaps in a fin as seen in a photomicrograph of an actual tube which was knurled before finning; and FIG. 6 is a view similar to FIG. 5 except that it shows the cross-section of gaps produced when the knurling tools used to produce the tube of FIG. 5 are applied to a tube after finning rather than before.

DESCRIPTION OF THE PREFERRED EMBODIMENT

FIG. 1 is illustrative of a tube indicated generally at 10 made in accordance with the present invention. The tube 10 is preferably made with plain, unfinned portions 12 on each of its ends to facilitate connection of the tube to tubesheets or fittings. The tube may be made with the apparatus 13 shown in FIG. 3 by feeding it from left to right over a mandrel 14 until the right end portion which is to be left plain has passed the final finning discs 16. At this point, the skewed axis rotating tool arbors 18,20 and 22 are gradually moved until the knurling tools 26,28, the initial finning discs 30 and the final finning discs 16 are positioned in full depth contact with the tube 10 by virtue of the fact that the arbors are pivoted on cam arms 32 for movement toward and away from the mandrel 14. Since the tube 10 moves to the right as it is engaged by the various tools, it is obvious that, once the arbors are in operating position, the tube will be knurled in the diamond pattern produced by the opposed diagonal knurling ridges on knurls 26,28 before it is finned. The portions which have been knurled will then successively be initially and then finally finned by finning discs 30 and 16 respectively. As can be seen in more detail in FIG. 4, the knurling and finning tools 26,30 and 16 are generally tapered to permit them to gradually deform the advancing tube.

FIGS. 2 and 5 illustrate the type of fin splitting or gaps produced by our improved method of knurling a tube before it is finned. Since the gaps 36,136 have a width which tapers down to zero in a generally radially inward direction, they will provide a variable width groove which permits vapor bubbles to form at the most favorable depth for the type of boiling liquid being used. Tests indicate that, up to a point, the more fins that are used and the greater the number of splits 36, 136 that are present, the more the heat transfer capability of the tube will be increased in boiling. For example, we have found that a standard No. 265028 tube having 26 fins per inch, a 0.0625 inch root diameter and a wall thickness under the fins of 0.028 inch which was knurled before finning to a depth of about 0.005–0.007 inches with 33 teeth per inch tools 26,28 having a tooth pitch of 0.030 in. provided, for a given heat flux, an improvement in the single-tube boiling coefficient in refrigerant R-12 of about 28% as compared to a tube having identical fins but without the pre-knurling feature. In refrigerant R-11, the improvement for a 26 fin per inch tube was found to be 43% with a 33-knurl tool. Where a 21-knurl tool having a pitch of 0.048 inches was used with 26 fin tube in R-11, the improvement was only 27%. However, when 35 fin tubes knurled with 33-knurl and 21-knurl tools were tested, the improvement was 23% and 20%, respectively, as compared to unknurled tube. From the preceding limited tests one might conclude that, given a choice of 26 or 35 fin tubing and 21 or 33-knurl tools, the maximum improvement is derived from using a 33-knurl tool with a 26 fin tube. Perhaps the reason for this is that the 35 fin tube has a lower profile than the 26 fin tube and thus less stress and less propensity for splitting.

Testing also indicated that subjecting a knurled and finned tube having 35 fins per inch and knurled with a 33-knurl tool to a cross-roll straightening operation improved the boiling coefficient by 36% for copper and 45% for aluminum as compared to unknurled 35 fin tube. This suggests that the basic differences in the splits between the 26 and 35 fin per inch tubes are corrected by the cold working provided by the cross-straightening rolls.

As indicated in FIG. 5, the actual shapes of the gaps 136 produced on a tube 110, as disclosed by a photomicrograph of an actual tube taken in the mid-plane of a fin midway between its side walls, vary considerably. The gaps 136 shown were produced by knurling a tube with a 21-knurl tool prior to finning it so as to produce 26 fins per inch. The gaps 136 have a depth of about 0.007–0.010 inches and a generally tapered width which varies from 0 at the bottom to an average width of about 0.003 inches or less at the outer periphery of the fin. Depending on the amount of cold working provided by the knurling and finning tools and the knurling depth, the gaps could vary in depth and width to perhaps 0.025 and 0.006 inches respectively. The distance between gaps will vary from fin to fin depending upon whether a fin crosses the knurled grooves near or far from an intersection of grooves formed by tools 26,28. In any event, the distance between adjacent gaps 136'—136' and 136''—136'' is always the same since gaps 136' would be made by tool 28, for example, and gaps 136'' would be made by tool 26. Sometimes, however, only the grooves formed by one of the tools 26,28 in a particular fin wall split to form fissure like gaps while the remaining grooves retain their original shape.

In FIG. 6, wide, uniform gaps 236 of the kind known to the prior art are shown in the tips of a finned tube. These gaps, which would provide little if any improvement over unknurled fin tube, were made by knurling after finning rather than before and have a maximum width of about 0.025 inches and a depth of about 0.010 inches. Although not visible in the drawings, the metal moved during knurling of the gaps 236 would flow partially along the axis of the gap so as to extend axially beyond the maximum axial fin dimension prior to knurling. As can be seen in FIGS. 1 and 2, the generally planar side walls 38, of the tube 10 are smooth and have no projecting metal near the gaps since the fins are formed after knurling. Knurling after finning as in FIG. 6 would move the metal displaced from the gaps 236 outwardly into the space between the fins.

Although tests were only made with copper and aluminum tubes, it is expected that tubes made of other metals would also produce splits or gaps when cold worked prior to finning. Likewise, while only tubes having 26 and 35 fins per inch were tested, it is expected that other common types of finned tube having anywhere from 11–50 fins per inch would exhibit improved performance if the fins were split to form gaps. Knurling tools having between about 10–40 teeth per inch should produce sufficient gaps (between 20–80) in the fin tips to improve performance. Although the fins are disclosed as extending radially, it is also contemplated that they can be bent over to provide additional nucleate boiling sites in the space between the fins.

We claim as our invention:

1. A heat exchanger tube comprising a tube wall having integral, radially extending fins formed in its outer surface, the tips of the fins including a plurality of fissure like transverse gaps around their peripheries, at least the majority of said gaps having a depth less than the height of the fin and a tapered width in the range from 0 to about 0.006 inches.

2. The heat exchange tube of claim 1 wherein the side surfaces of said fins are substantially smooth and free of outward projections at the base portions of said fissure like gaps.

3. The heat exchanger tube of claim 1 wherein said tube has between 26 and 35 fins per inch formed in its outer surface.

4. The heat exchanger tube of claim 1 wherein said tube has between 11 and 50 fins per inch formed in its outer surface.

5. The heat exchange tube of claim 4 wherein said tube has between 10 and 80 fissure like gaps per inch formed in the tip edges of its fins.

6. The heat exchange tube of claim 4 wherein said tube has between 20 and 70 fissure like gaps per inch formed in the tip edges of its fins.

7. The heat exchange tube of claim 6 wherein said fissure like gaps extend less than about 25% of the distance between the fin tips and the fin roots.

8. The heat exchange tube of claim 7 wherein said fissure like gaps are at an angle to the axis of the tube.

9. The heat exchange tube of claim 8 wherein about half the fissure like gaps are at a first positive angle to a line parallel to the axis of the tube and the other half are at a second negative angle to said line.

10. The heat exchange tube of claim 9 wherein said first and second angles are equal in magnitude and are about 30°.

* * * * *